US009462842B2

(12) United States Patent
Hoshizaki et al.

(10) Patent No.: US 9,462,842 B2
(45) Date of Patent: Oct. 11, 2016

(54) HEAD PROTECTION FOR REDUCING LINEAR ACCELERATION

(71) Applicant: University of Ottawa, Ottawa (CA)

(72) Inventors: Thomas Blaine Hoshizaki, Rockcliffe Park (CA); Andrew Michael Post, Ottawa (CA)

(73) Assignee: University of Ottawa, Ottawa, Ontario (CA)

( * ) Notice: Subject to any disclaimer, the term of this patent is extended or adjusted under 35 U.S.C. 154(b) by 671 days.

(21) Appl. No.: 13/788,669

(22) Filed: Mar. 7, 2013

(65) Prior Publication Data

US 2014/0013491 A1 Jan. 16, 2014

Related U.S. Application Data

(60) Provisional application No. 61/620,162, filed on Apr. 4, 2012.

(51) Int. Cl.
*A42B 3/12* (2006.01)
*A42B 3/06* (2006.01)

(52) U.S. Cl.
CPC *A42B 3/12* (2013.01); *A42B 3/064* (2013.01)

(58) Field of Classification Search
CPC ..... A42B 3/12; A42B 3/121; A42B 3/122; A42B 3/064
See application file for complete search history.

(56) References Cited

U.S. PATENT DOCUMENTS 3,254,883 A * 6/1966 Morgan ..... A42B 3/12 2/413
3,872,511 A * 3/1975 Nichols ..... A42B 3/121 2/413
3,877,076 A 4/1975 Summers et al.
4,307,471 A * 12/1981 Lovell ..... A42B 3/065 2/411
4,558,470 A 12/1985 Mitchell et al.
5,204,998 A * 4/1993 Liu ..... A42B 3/121 2/411
5,687,426 A * 11/1997 Sperber ..... A42B 3/061 2/411

(Continued)

FOREIGN PATENT DOCUMENTS

CA 2772644 6/2012
CN 1075867 9/1993

*Primary Examiner* — Shaun R Hurley
*Assistant Examiner* — Andrew W Sutton
(74) *Attorney, Agent, or Firm* — Adrian D. Battison; Ade & Company Inc.

(57) ABSTRACT

Safety head wear for use for example in high risk activities such as sports and industrial purposes where protection from head injuries is required. Components are provided inserted between the liner and outer shell and consists of two parts; a pod and a foam or foam like surrogate or structure. The foam or foam like material is contained in the chamber and is positioned in such a way to create constant force between the surface of the shell and head. The device provides a method of managing compression force characteristics of the helmet around the head designed to decrease brain trauma resulting from high linear acceleration during impacts to the helmet.

21 Claims, 5 Drawing Sheets

(56) References Cited

U.S. PATENT DOCUMENTS

2004/0107482 A1* 6/2004 Picotte ..... A42B 1/08 2/411
2006/0059606 A1* 3/2006 Ferrara ..... A01N 25/18 2/412
2007/0190292 A1* 8/2007 Ferrara ..... A42B 3/121 428/166
2010/0186150 A1* 7/2010 Ferrara ..... A42B 3/128 2/412
2011/0047685 A1* 3/2011 Ferrara ..... A42B 3/063 2/455
2012/0151664 A1* 6/2012 Kirshon ..... A42B 3/12 2/413
2012/0233745 A1* 9/2012 Veazie ..... A42B 3/121 2/413
2013/0086733 A1* 4/2013 Szalkowski ..... A42B 3/12 2/414
2013/0125294 A1* 5/2013 Ferrara ..... A42B 3/064 2/411
2013/0247284 A1* 9/2013 Hoshizaki ..... A42B 3/12 2/413
2014/0013491 A1* 1/2014 Hoshizaki ..... A42B 3/064 2/411
2015/0223545 A1* 8/2015 Fraser ..... A42B 3/121 2/413

* cited by examiner

FIG. 8A
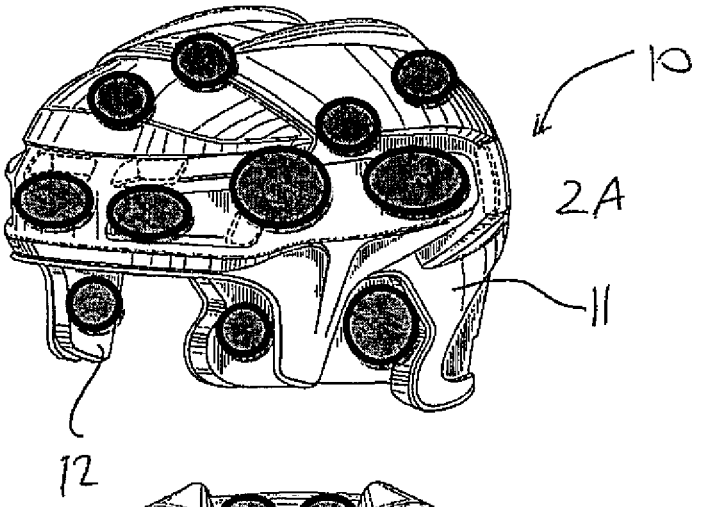
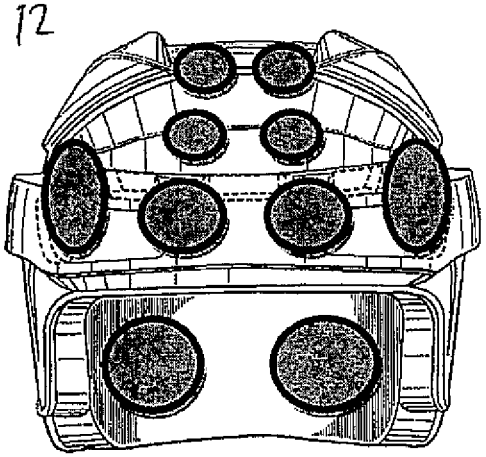
FIG. 8B
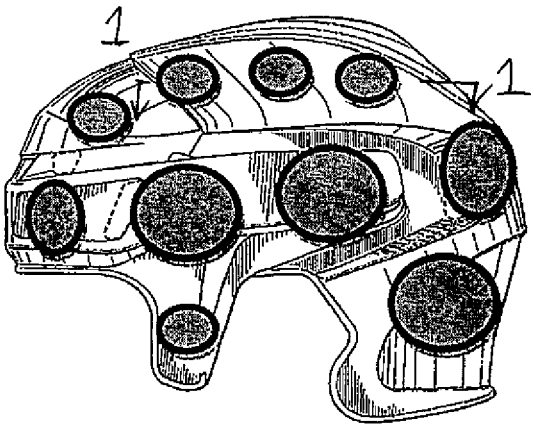
FIG. 8C

HEAD PROTECTION FOR REDUCING LINEAR ACCELERATION

This application claims the benefit under 35 USC119 (e)) of Provisional application 61/620,162 filed Apr. 4th 2012.

This invention relates to safety head wear used for protection of the head from impacts to the head which can be used in high risk activities such as sports or for other purposes such as in industrial or worksite applications where protection from head injuries is required.

BACKGROUND OF THE INVENTION

Head injuries in sport have been described as an epidemic especially in contact sports like football, hockey and lacrosse. While catastrophic head and brain injuries are generally managed effectively, helmets have had little effect on the incidence of concussive injuries. In part, this is the result of helmets used in sport, recreational pursuits and industry having primarily been designed to prevent catastrophic head injuries. Head injuries resulting from direct impacts are characterized by both linear and angular accelerations of the head during the impact. Certain types of head injuries like skull fractures and intracranial bleeds are associated with linear accelerations. Impact is managed by using compliant foams and foam surrogates that are designed by primarily changing the thickness and stiffness characteristics. As a result the foams perform effectively during a very small portion of the energy absorbing range. Ideally an energy absorbing liner is engineered to absorb the greatest amount of energy during its full range of compression. Typically foams do not provide sufficient stiffness during the initial compression then work efficiently until they become too stiff and begin to transfer force to the head. As a result the capacity of the energy absorbing material is inefficient.

SUMMARY OF THE INVENTION

It is one object of this invention to provide an improved helmet which provides a reduction in the linear forces on the head of the wearer.

According to one aspect of the invention there is a provided headwear used for protection of the head of a wearer from impact accelerations comprising:

an outer member for engaging external objects in potential contact with the head of the wearer;

an inner layer for engaging an outer surface of the head of the wearer;

a plurality of compressible components arranged between the outer member and the inner layer at spaced positions around the head of the wearer;

the components being arranged to compress in a direction generally orthogonal to the surface of the head so as to absorb the impacts;

each component comprising:

- a body having an inner surface for engaging the inner layer and an outer surface for engaging the outer components;
- the body having a peripheral wall having the compression characteristics such that the peripheral wall is collapsible when a load is applied between the inner and outer surfaces greater than a predetermined load;
- a compressible body within the peripheral wall and having the compression characteristics to provide a resistance to compression;

such that the component responds to impact forces by combining the characteristics of the compressible body and the peripheral wall.

Preferably the inner layer comprises a stiff inner liner for engaging the outer surface of the head and the outer member comprises an outer shell and wherein the components are arranged between the inner liner and the outer shell for absorbing the forces applied between the outer shell and the head.

Preferably there is provided a stiff inner liner at the inner layer for engaging the outer surface of the head and there may be provided a rigid outer shell at the outer layer where the components are arranged between the inner liner and the outer shell for absorbing the linear forces applied between the head and the outer layer.

Alternatively an arrangement can be provided which does not include an additional rigid shell so that the compressible components are directly engaged at the outer surface of the peripheral wall thereof by objects impacting the headwear.

Preferably the peripheral wall of the compressible body provides a collapsible material which is provided to accommodate compression forces. The compressible body is preferably a solid body formed of a resilient material such as a resilient foam material.

However the compressible body is a solid body formed which can be formed of other materials having the same or similar compression characteristics to foam such as a molded plastics material.

In some cases the compressible body fills the hollow interior of the peripheral wall.

However, more preferably the compressible body has a height less than that of the hollow interior of the peripheral wall so as to be spaced from one or both of the inner and outer walls. In this way the compression of the component commences at the predetermined load when the peripheral wall commences to collapse and then the interior solid body commences to resist the collapse when the material begins to compress. Preferably in this arrangement the compressible solid body is shaped to engage the peripheral wall around its full periphery. However it may be smaller.

In an alternative arrangement, the compressible solid body has a height equal or greater to that of the peripheral wall and a peripheral extent less than that of the peripheral wall.

Preferably the peripheral wall is formed from a plastics material. However other materials and methods of manufacture can be used provided the material provide the collapse characteristics required. For example the peripheral wall can be molded from a plastics material.

Preferably but not necessarily the peripheral wall has the walls thereof which are sufficiently elastic, in conjunction with elastic forces from the interior core material to cause the peripheral wall to resume its initial shape after the forces causing collapse are removed. This may occur slowly over a period of time, but the intention is that the components revert to their original condition after an impact for continued use.

In order to allow collapse, the peripheral wall is typically not air tight or closed so as to allow air to be expelled on collapse.

Preferably the combined characteristics of the peripheral wall and the solid body are arranged such that the first response of the component under forces is that it is collapsible when a load is applied between the inner and outer surfaces greater than a predetermined load up to a predetermined distance of compression following which the compressible body acts to resist further compression.

Preferably the combined characteristics of the peripheral wall and the solid body are arranged to provide a force curve that absorbs energy at a substantially constant rate throughout the duration of the impact.

Preferably the combined characteristics of the peripheral wall and the solid body are arranged to provide a force curve that absorbs energy at a substantially constant rate as the component is compressed.

In one arrangement the peripheral wall is cylindrical and of constant thickness.

However the peripheral wall can also be frustoconical or tapered or may have other more complex shapes in cross-section. For example the peripheral wall can be of varying thickness along its height.

Preferably the compressible body is mounted in a flexible support which allows lateral movement of the body relative to one or both of the inner layer and the outer member to allow shearing movement of the inner layer relative to the outer member. For example the flexible support can comprise an elastic membrane which attached to the peripheral wall.

According to a second aspect of the invention there is provided headwear used for protection of the head of a wearer from impact accelerations comprising:

an outer member for engaging external objects in potential contact with the head of the wearer;

an inner layer for engaging an outer surface of the head of the wearer;

a plurality of compressible components arranged between the outer member and the inner layer at spaced positions around the head of the wearer;

the components being arranged to compress in a direction generally orthogonal to the surface of the head so as to absorb the impacts;

wherein the compressible components are mounted in a flexible support which allows lateral movement of the body relative to one or both of the inner layer and the outer member to allow shearing movement of the inner layer relative to the outer member.

For example the flexible support can comprise an elastic membrane which attached to the peripheral wall.

The arrangement as described in more detail hereinafter relates to safety head wear for use in high risk activities such as sports and industrial purposes where protection from head injuries is required.

For example one feature of this device as describer hereinafter is to provide an impact absorbing device to be used in a helmet which is designed to create a force curve that absorbs energy at a substantially constant rate throughout the duration of the impact.

The device includes a pod like structure forming the components with two parts, a circular or peripheral wall of varying thickness and a foam or foam like material or structure contained within the pod to manage energy when the outer walls become less effective. The device provides a method of managing the compressive force characteristics of the helmet around the head designed to decrease the brain trauma resulting from high linear acceleration during impacts to the helmet. The device consists of a pod that has foam, foam like material or a structure designed to manage forces when the peripheral wall of the outer pod no longer manage forces efficiently. The resulting effect is to decrease the magnitude of the forces acting on the head thus decreasing the risk of head and brain injuries associated with these forces. The arrangement described herein can be used in conjunction with traditional materials and structures or on its own depending on the needs of the helmet.

This device is intended to manage the forces resulting from an impact to the head by decreasing the resulting linear accelerations of the head. Specifically the arrangement described herein provides a means to manage the linear forces during an impact to the head. This invention can be used but is not limited to helmets used in sport like hockey, football, lacrosse, alpine skiing, cycling and motor sport as well as safety helmets for industrial and transportation applications.

The example provided in FIG. 2 and described hereinafter demonstrates the use of the device in a helmet. In this example the device can be positioned between the liner and the shell. The device is made up of a series of flexible components at spaced positions around the head of the wearer, each containing an outer structure or peripheral wall with an inner structure. This device allows the outer surface of the helmet to move orthogonal to the surface of the head of the wearer in a controlled fashion to decrease linear acceleration of the head.

Direct impacts to the head provide impacts that are the result of a moving object contacting the head as in an elbow of a player impacting a stationary player's head or a tackler's helmet impacting a stationary player's helmet or when the head is moving and comes in contact with a stationary object. For example when a person falls to the ground and the head is moving until it comes in contact with the stationary ground.

Linear acceleration occurs when an object with mass and velocity contacts the head or the head is moving with mass and velocity and the resulting acceleration from the impact is in a linear or straight manner.

Protective headwear as defined herein includes any headwear designed to be worn to decrease the risk of a head injury. Most commonly used in sporting activities and industrial applications.

A helmet as defined herein comprises protective headwear used to protect wearers from hazards generally made up of as shell, liner and retention system.

A shell as defined herein comprises the outer layer of a helmet generally consisting of a harder material and is often designed to distribute the force over a larger area. It is generally made up of harder materials like polycarbonate, polyethylene or composite materials.

A liner as defined herein comprises the part of the helmet that is primarily responsible for the energy management of a helmet and can be made up of vinyl nitrile or polystyrene or polypropylene foams, or plastic structures designed to absorb energy.

Compression forces or normal forces arise from the force vector component perpendicular to the material cross section on which it acts.

BRIEF DESCRIPTION OF THE DRAWINGS

FIGS. 8A, 8B and 8C show isometric, front and side views of the helmet including a series of the components inserted into the helmet.

DETAILED DESCRIPTION

Figure 1:
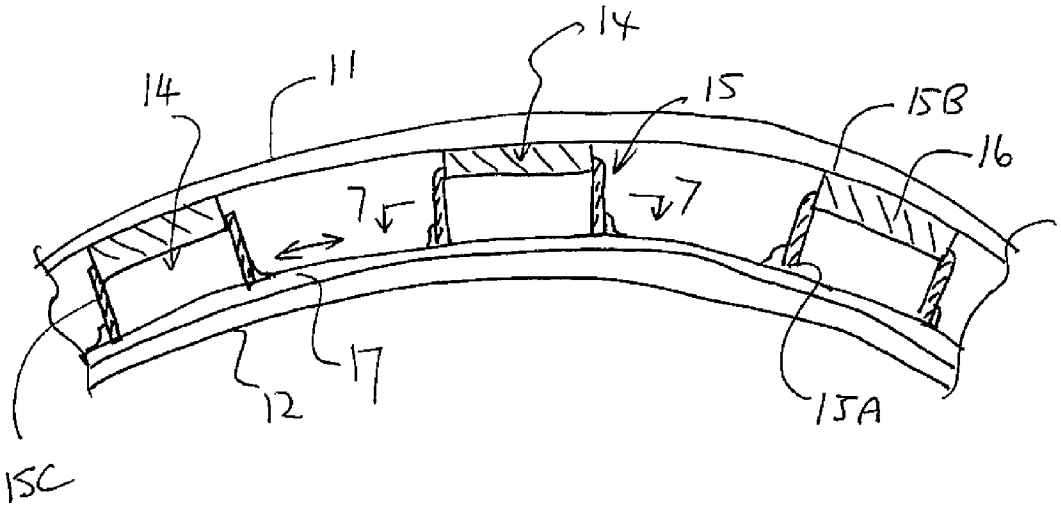
FIG. 1 is a cross-sectional view through a portion of the outer wall of a helmet according to the present invention taken along the lines 1-1 of FIG. 8C showing three compressible components of a first embodiment in a row between an outer shell and an inner liner of the helmet.

The headwear used for protection of the head from impacts to the head includes an inner layer 12 for engaging an outer surface of the head of the wearer and an outer layer 11. Between the layers is provided a plurality of compressible components 14 arranged at spaced positions around the head of the wearer.

Thus the components compress in a direction orthogonal to the surface of the head so as to absorb the impacts on the exterior.

Each component 14 comprises a hollow body 15 having an inner surface or edge 15A for engaging the inner layer, an outer surfaced or edge 15B and a peripheral wall 15C. The peripheral wall 15C has compression characteristics such that it is collapsible when a load is applied between the inner and outer surfaces greater than a predetermined load.

Inside the peripheral wall of the hollow body is a compressible body 16 within the component 14 which has compression characteristics to provide a resistance to compression such that the component responds to impact forces by combining the characteristics of the peripheral wall and the solid body.

The component 14 is in the shape of a circular disk with parallel top and bottom surfaces for engaging the inner and outer layers. However shapes other than circular may be used such as square or elliptical.

The compressible body 16 provides a collapsible resilient material such as a solid foam which is provided to accommodate compression forces.

The compressible body is a solid body formed of molded plastics material.

Figure 2:
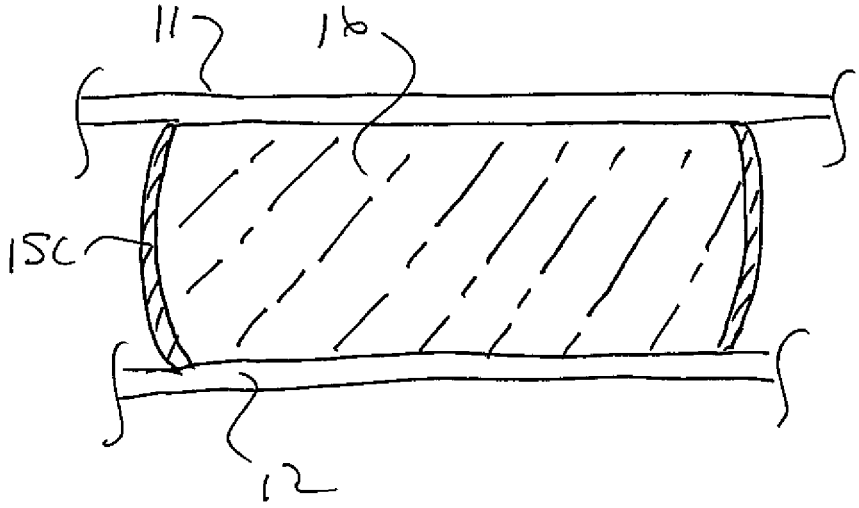
FIG. 2 is a cross-sectional view of one of the compressible components showing a second embodiment.

In FIG. 2 the compressible body fills the hollow interior.

Figure 3:
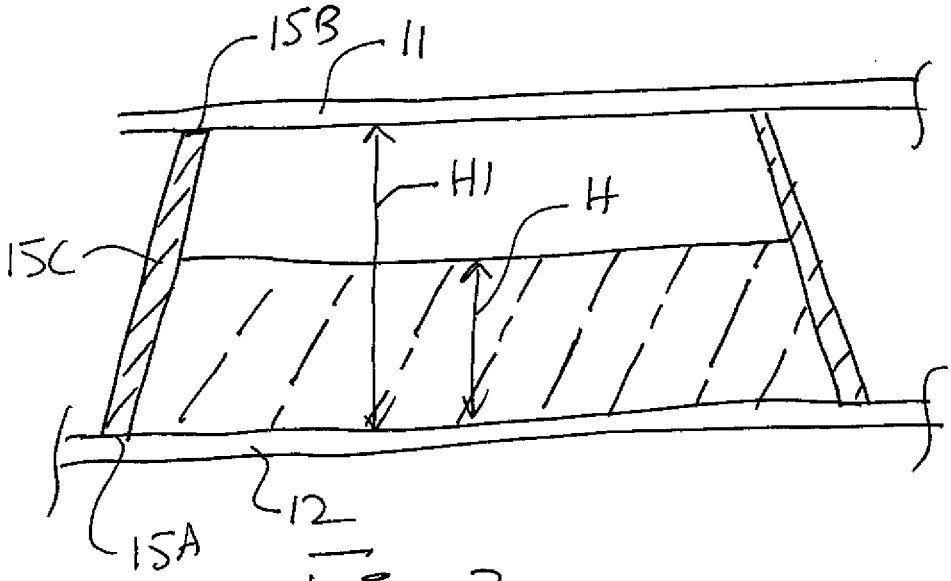
FIG. 3 is a cross-sectional view of one of the compressible components showing a third embodiment.

In FIG. 3 the compressible body has a cross-section matching that of the hollow body but has a height H less than the height H1 of the hollow interior so as to be spaced from one or both of the inner and outer surfaces and as shown spaced form the top surface 15B at the layer 11.

This describes the foam being against the surface of the head when another design has the foam between the pod and the inner surface of the shell 11. Both variations can be used. That is the foam 16 can be attached to the inner surface of the bottom wall spaced from the inner surface of the peripheral walls and spaced from the inner surface of the top wall.

Figure 1A:
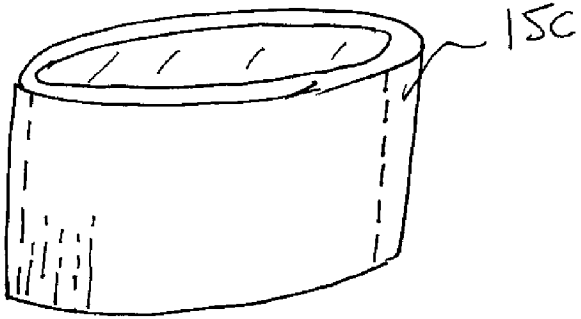
FIG. 1A is an isometric view of one of the compressible components which is to be inserted into the helmet.

Thus, as shown in FIGS. 1A and 2, the compressible solid body is shaped to engage the peripheral wall 15C around its full periphery.

Figure 5:
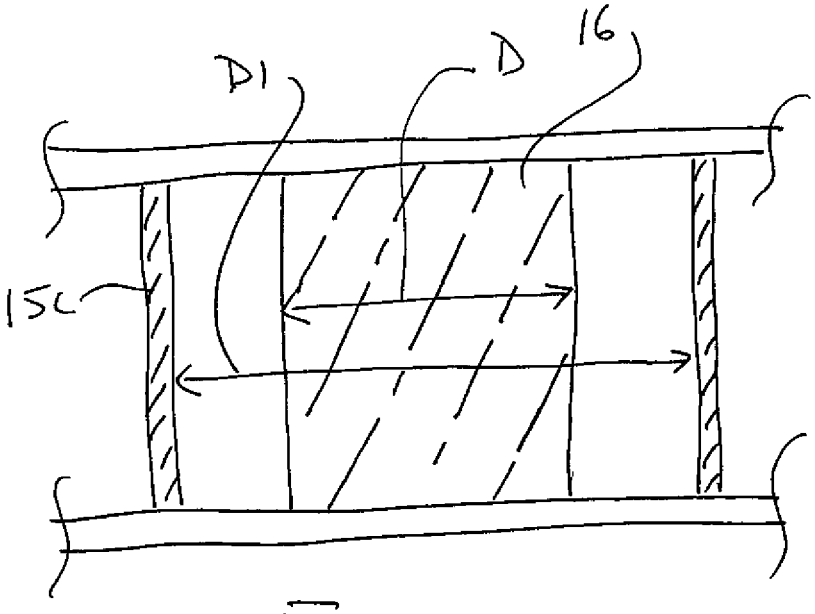
FIG. 5 is a cross-sectional view of one of the compressible components showing a fifth embodiment.

In FIG. 5 the compressible solid body has a height equal to that of the hollow interior and a peripheral extent D less than D1 of the peripheral wall. That is the diameter of the foam piece is less than the diameter of the inner surface of the peripheral wall The component 14 has the walls thereof formed by injection molding from a plastics material. The molded walls are arranged such that the component 14 has the walls thereof which are sufficiently elastic to cause the component 14 to resume its initial shape after the forces causing collapse are removed. The component 14 is not air tight so as to allow air to be expelled on collapse so that it does not form a gas bag spring.

The combined characteristics of the peripheral wall and the solid body are arranged such that the first response of the component under forces is that it is collapsible when a load is applied between the inner and outer surfaces greater than a predetermined load up to a predetermined distance of compression following which the compressible body 16 acts to resist further compression. In particular the combined characteristics of the hollow body and the solid body are arranged to provide a force curve that absorbs energy at a substantially constant rate throughout the duration of the impact. In other words the combined characteristics of the hollow body and the solid body are arranged to provide a force curve that absorbs energy at a substantially constant rate as the component is compressed.

A component 14 is provided herein consists of one or more compartments to contain a foam or foam surrogate or structure to manage compressive forces resulting from an impact.

This device is intended to manage the forces resulting from an impact to the head by decreasing the resulting linear accelerations of the head. This invention can be used but is not limited to helmets used in sport like hockey, football, lacrosse, alpine skiing, cycling and motor sport as well as safety helmets for industrial and transportation applications.

The example provided in FIGS. 8A, 8B and 8C demonstrates the use of the device in an ice hockey helmet. In this example the device is positioned between the head and the shell. The device is made up of a series of flexible pods containing foam or foam surrogates or structures to manage compressive forces resulting from an impact.

The invention consists of a pod filled with a foam, foam like material or structure designed to manage the force resulting from an impact. The peripheral wall is designed to collapse at a defined magnitude until it is no longer effective at which time the foam or foam like material or structure inner walls manages the force to maintain effective management of the transmitted forces designed to minimize the magnitude of the force transmitted to the head controlling the rate of linear acceleration of the head during the impact.

The invention can be used in conjunction with existing technologies like low friction bladders or a flexible mounting system designed to decrease angular acceleration. In operation this device is placed between the shell and the skull around the head. The invention allows the designer to create the necessary compression characteristics to ensure the resulting linear acceleration from an impact is managed to reduce the risk of a head injury.

The invention is made up of an outer ring or peripheral wall that can vary in diameter, thickness and stiffness and consists of polyethylene material and is designed in such a way to ensure the collapse is predictable and consistent. The outer ring or peripheral wall can consist of both ends open with no material or with one or the other void of material. It can be filled with foam, foam surrogates or a structure designed so that the foam is thicker than the walls or is thinner than the height of the walls depending on the forces it is designed to manage.

The structures are anatomically shaped to follow the head and positioned at the front of the head (forehead), sides of the head (parietal), at the temple region, the back of the head (occipital) and the top of the head (crown). The structures are attached to the shell using adhesive or metal fasteners.

Figure 6:
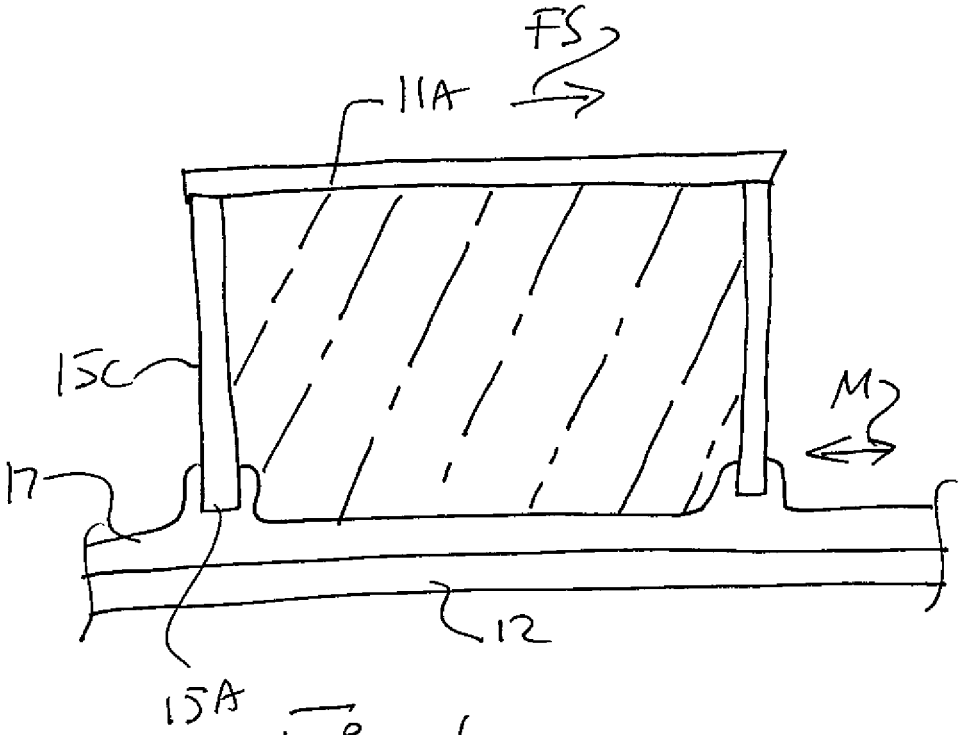
FIG. 6 is a cross-sectional view of one of the compressible components showing a sixth embodiment.
Figure 7:
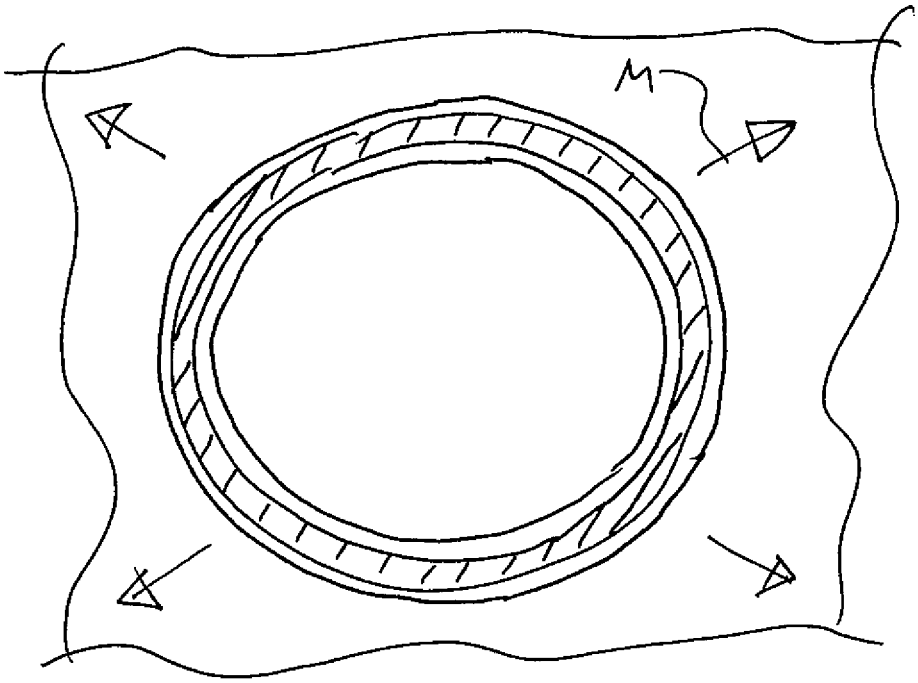
FIG. 7 is a cross-sectional view along the lines 7-7 of FIG. 1.

As shown in FIGS. 1, 1A and 6, the peripheral wall is cylindrical and of constant thickness.

However as shown in FIG. 3, the peripheral wall 15C is frustoconical or tapered with either the larger end at the layer 11 or at the layer 12.

Figure 4:
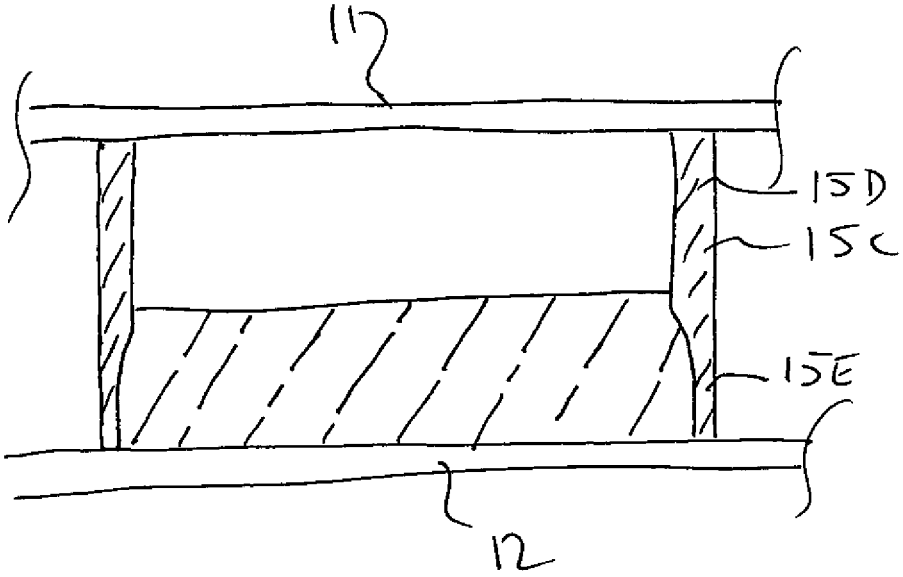
FIG. 4 is a cross-sectional view of one of the compressible components showing a fourth embodiment.

As shown in FIG. 4 the peripheral wall 15C is of varying thickness along its height as shown at 15D, 15E. These variations can be used to tailor the collapse to a required force curve. The position of the thinner wall portions can be located at the foam or remote from the foam As shown in FIGS. 1 and 6 the compressible body is mounted in a flexible support layer 17 which allows lateral movement M of the body relative to one of both of the inner layer 12 and the outer member 11 to allow shearing movement of the inner layer relative to the outer member. That is shearing force along the line FS causes one end of the component to move along the line M to reduce the shearing action and thus the angular rotation of the head in response to the shearing force FS.

In the example shown, the flexible support 17 comprises an elastic membrane which attached to the peripheral wall 15C at its inner end 15A. This allows the end 15A to move sideways long the line M by stretching of the membrane 17. However other mounting systems can be used. For example a sliding bladder arrangement can be used of the type disclosed in co-pending Application PCT/CA2013/050017 by the present Assignees, the disclosure of which is incorporated herein by reference.

The invention claimed is:

1. Protective headwear for protection from a load generated by impact accelerations comprising:

an outer member for engaging external objects;

an inner layer having an inner surface and an outer surface;

a plurality of compressible components arranged between the outer member and the inner layer at spaced positions around the inner layer;

the compressible components being arranged to compress in a direction generally orthogonal to the inner layer so as to absorb said load;

each compressible component comprising:

a body having an inner surface for engaging the inner layer and an outer surface for engaging the outer member;

the body comprising a tubular peripheral wall having the compression characteristics such that the tubular peripheral wall is collapsible longitudinally when a load is applied between the inner and outer surfaces greater than a predetermined load;

and a compressible body located inside the tubular peripheral wall and having the compression characteristics to provide a resistance to compression;

such that each compressible component responds to said load by combining the characteristics of the peripheral wall and the resistance to compression of the compressible body.

2. The protective headwear according to claim 1 wherein the inner layer comprises a stiff inner liner and the outer member comprises an outer shell and wherein the components are arranged between the inner liner and the outer shell for absorbing the forces applied between the outer shell and the inner liner.

3. The protective headwear according to claim 1 wherein the outer member forms a part of the compressible components without an additional rigid shell so that the compressible components are directly engaged at the outer member by objects impacting the headwear.

4. The protective headwear according to claim 1 wherein the tubular peripheral wall is formed of a resilient material.

5. The protective headwear according to claim 1 wherein the tubular peripheral wall is formed of molded plastics material.

6. The protective headwear according to claim 1 wherein the compressible body is shaped to engage the tubular peripheral wall around its full periphery.

7. The protective headwear according to claim 1 wherein the tubular peripheral wall is sufficiently elastic to resume its initial shape after said load is removed.

8. The protective headwear according to claim 1 wherein the combined characteristics of the peripheral wall and the compressible body provide a force curve that absorbs energy at a constant rate throughout the duration of said load.

9. The headwear according to claim 1 wherein the combined characteristics of the peripheral wall and the compressible body provide a force curve that absorbs energy at a constant rate as the component is compressed.

10. The protective headwear according to claim 1 wherein the tubular peripheral wall is cylindrical and of constant thickness.

11. The protective headwear according to claim 1 wherein the tubular peripheral wall is frustoconical.

12. The protective headwear according to claim 1 wherein the tubular peripheral wall is of varying thickness along its height.

13. The protective headwear according to claim 1 wherein the compressible components are mounted in a flexible support which allows lateral movement of the compressible components relative to of the inner layer and the outer member to allow shearing movement of the inner layer relative to the outer member.

14. The protective headwear according to claim 13 wherein the flexible support comprises an elastic membrane which attached to the tubular peripheral wall.

15. Protective headwear for protection from a load generated by impact accelerations comprising:

an outer member for engaging external objects;

an inner layer having an inner surface and an outer surface;

a plurality of compressible components arranged between the outer member and the inner layer at spaced positions around the inner layer;

the compressible components being arranged to compress in a direction generally orthogonal to the inner layer so as to absorb said load;

the compressible components being separated each from the next by an open space free of intervening material so that the compressible components are free to compress independently of one another without resistance from material in the open space;

each compressible component comprising:

a body having an inner surface for engaging the inner layer and an outer surface for engaging the outer member;

the body comprising a single tubular peripheral wall having the compression characteristics such that the tubular peripheral wall is collapsible longitudinally when a load is applied between the inner and outer surfaces greater than a predetermined load, the tubular peripheral wall being unsealed to allow air escape during collapse so that resistance to collapse is provided by the tubular peripheral wall;

and a compressible body located inside the tubular peripheral wall and having the compression characteristics to provide a resistance to compression;

wherein the compressible body has a height less than that of the tubular peripheral wall so as to be spaced from one or both of the inner layer and outer member;

at least a part of the tubular peripheral wall being free from contact with the compressible body so as to be collapsible longitudinally without resistance from engagement with the compressible body;

such that each compressible component responds to said load by combining the characteristics of firstly the collapse of the peripheral wall and subsequently the resistance to compression of the compressible body.

16. The protective headwear according to claim 15 wherein the inner layer comprises a stiff inner liner and the outer member comprises an outer shell and wherein the components are arranged between the inner liner and the outer shell for absorbing the forces applied between the outer shell and the inner liner.

17. The protective headwear according to claim 15 wherein the outer member forms a part of the compressible components without an additional rigid shell so that the compressible components are directly engaged at the outer member by objects impacting the headwear.

18. The protective headwear according to claim 15 wherein the tubular peripheral wall is cylindrical and of constant thickness.

19. The protective headwear according to claim 15 wherein the tubular peripheral wall is frustoconical.

20. The protective headwear according to claim 15 wherein the tubular peripheral wall is of varying thickness along its height.

21. The protective headwear according to claim 15 wherein the compressible components are mounted in a flexible support which allows lateral movement of the compressible components relative to one or both of the inner layer and the outer member to allow shearing movement of the inner layer relative to the outer member.

* * * * *